United States Patent [19]

Lau et al.

[11] 4,022,313

[45] May 10, 1977

[54] RIBBON LIFTING MECHANISM

[75] Inventors: Edward H. Lau, Old Westbury; Mosi Chu, Port Jefferson, both of N.Y.

[73] Assignee: Redactron Corporation, Hauppauge, N.Y.

[22] Filed: Nov. 19, 1975

[21] Appl. No.: 633,441

[52] U.S. Cl. ..... 197/167; 197/158

[51] Int. Cl.[2] ..... B41J 35/14

[58] Field of Search ..... 197/157, 158, 166, 167

[56] References Cited

UNITED STATES PATENTS

| | | | |
|---|---|---|---|
| 2,672,092 | 3/1954 | Beattie | 197/158 X |
| 3,171,530 | 3/1965 | O'Daniel et al. | 197/151 |
| 3,349,888 | 10/1967 | Page | 197/158 |
| 3,451,520 | 6/1969 | Greer et al. | 197/157 |
| 3,584,722 | 6/1971 | Albrile | 197/158 |
| 3,613,857 | 10/1971 | Thevis et al. | 197/158 X |
| 3,782,521 | 1/1974 | Hengelhaupt | 197/158 |
| 3,863,749 | 2/1975 | Perry et al. | 197/158 X |
| 3,882,989 | 5/1975 | Morelli | 197/157 X |

*Primary Examiner*—Edgar S. Burr
*Assistant Examiner*—Paul T. Sewell
*Attorney, Agent, or Firm*—Hane, Sullivan & Spiecens

[57] ABSTRACT

In a printer wherein a ribbon is driven against a platen by a print element there is provided a ribbon lifting mechanism having a one revolution motor which drives, via a n-to-1 reduction gear, a ribbon guide to pivot to different positions whereby different transverse portions of the ribbon are interposed between the impact region of the print element and the platen.

7 Claims, 5 Drawing Figures

98
100
20
96
92
94
90
56
54
52
58
60
54
62
44
52
65
64
68
69
82
88
30
34
20
66
36
80
32
58
42
84
84a
86
20
40
84b
70
38

RIBBON LIFTING MECHANISM

BACKGROUND OF THE INVENTION

This invention pertains to ribbon lifting mechanisms for printers such as typewriters.

In order to utilize more fully the available area of printer ribbons which are longitudinally pulled between the print element and the platen there have been devised what has become known as ribbon lifting mechanisms. In general, such a mechanism is raised from a home position below the impact area of the platen or of the print element to such impact area just before the print element strikes the platen. In general, conventional typewriter ribbons are about one-half inch wide and conventional impact areas about one-eighth inch high, thus it is seen that if there is only longitudinal feed of the ribbon a considerable portion of the transverse area of the ribbon is not used. This fact has been long recognized and there are available ribbon feeding mechanisms which ensure that the complete width of ribbon is used. A typical and commonly used ribbon feeding mechanism is described in U.S. Pat. No. 3,171,530, wherein a complicated multiple cam arrangement is used. Such appparatus requires the manufacture of a series of axially arrayed cams which are moved axially with respect to a cam follower in order to achieve the different transverse displacements of the ribbon. It has been found that the presently avaiable mechanism requires one drive for rotating the cams and a second drive for axially displacing the cams with respect to the cam follower. Thus, such devices are not only complex because of the multiple cams and axial displacements but are relatively noisy and subject to considerable wear because of all of the mechanical engagements and disengagements.

SUMMARY OF THE INVENTION

It is accordingly a general object of the invention to provide an improved ribbon lifting mechanism.

It is another object of the invention to provide such a mechanism which requires considerably less moving parts than previously available mechanisms and, therefore, is not only less expensive, but much more quiet.

Briefly, the invention contemplates, for use in a printer wherein a ribbon is driven against a platen by a print element, a ribbon lifting apparatus for controllably positioning different transverse regions of the ribbon between the platen and the print element at the time of impact. The apparatus comprises a ribbon guide means for carrying the ribbon. The guide means is supported to swing through an arc such that different transverse regions of tape are available for impact against the platen, a one revolution drive means drives an *n*-to-one reduction gear, which in turn drives an *n*-lobe cam. A cam follower rests on the *n*-lobe cam and is connected to the guide means for controlling its position along the arc in accordance with the profile of the cam.

DETAILED DESCRIPTION

Figure 1:
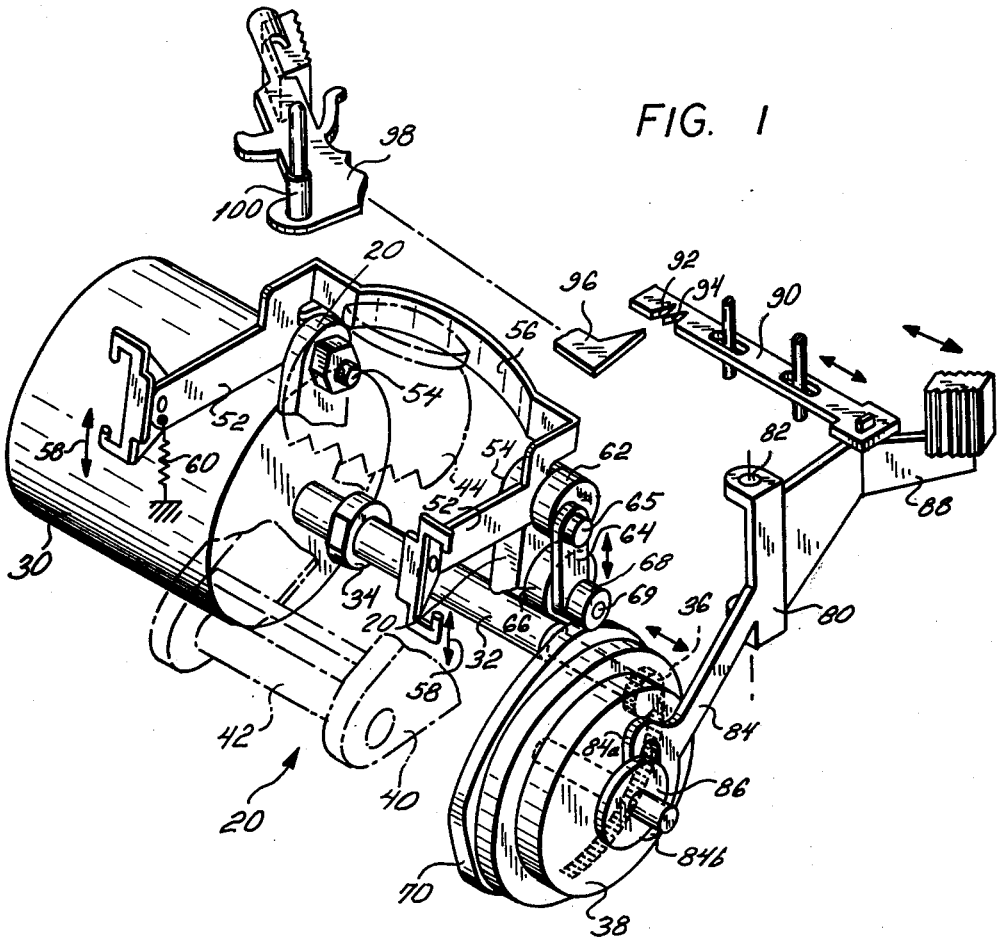
FIG. 1 shows a perspective view of those portions of a typewriter incorporating the invention.
Figure 2:
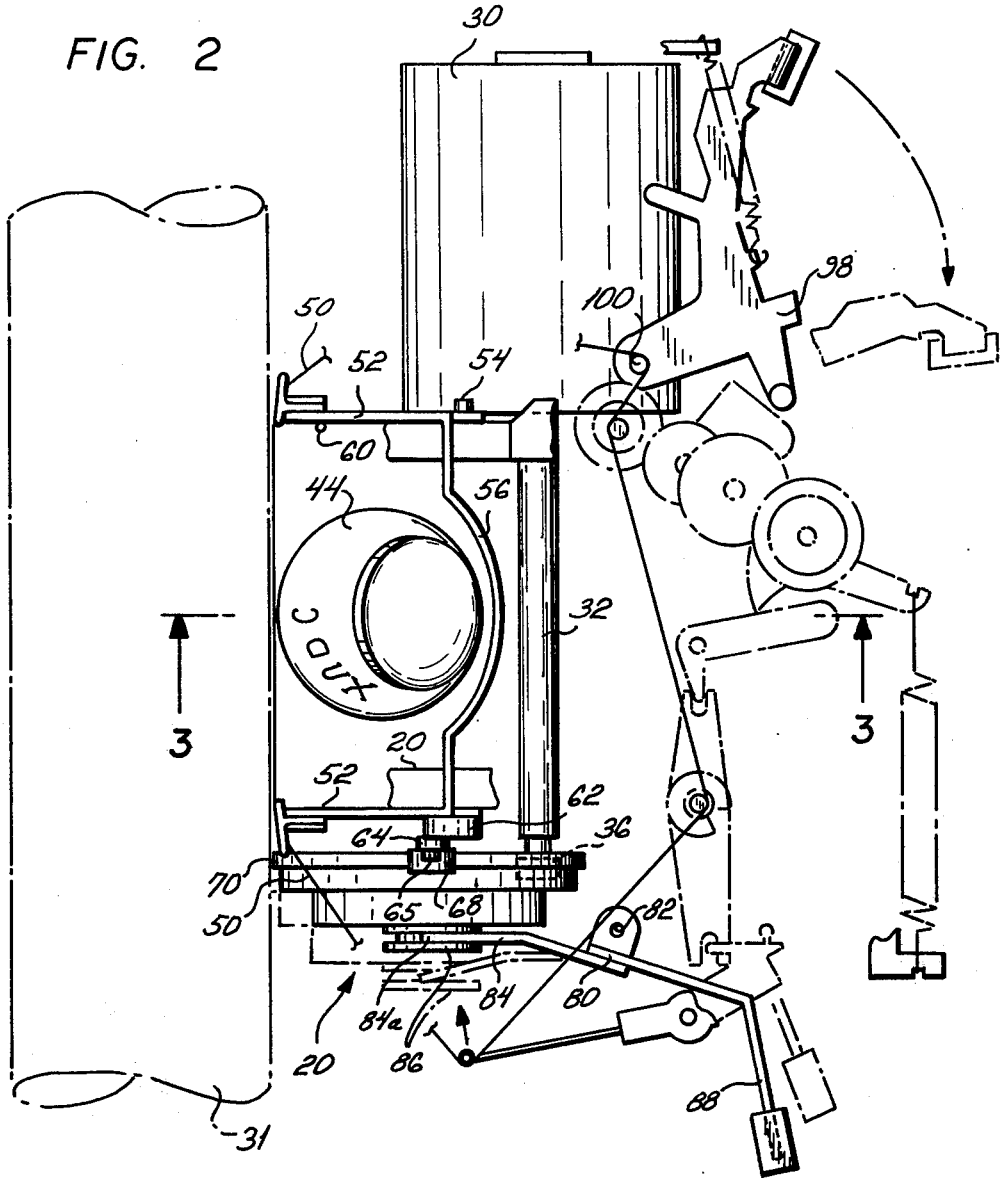
FIG. 2 is a top plan view of said portions of the typewriter.
Figure 3:
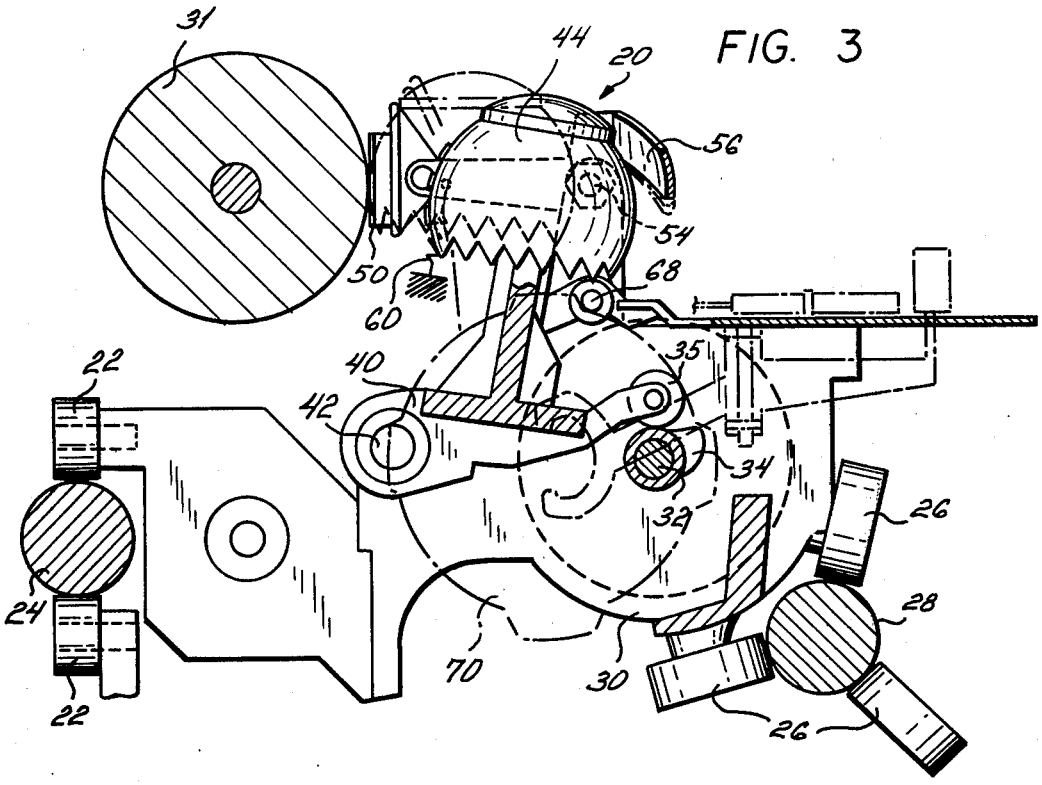
FIG. 3 is a sectional view taken along line 3—3 of FIG. 2.

In the drawings and particularly in FIGS. 1, 2 and 3, there is shown those portions of a printer or typewriter concerned with the actual printing of characters. A print carrier assembly 20 is trunnioned at a pair of rollers 22 straddling a traverse rod 24 fixed in a printer frame (not shown) and a set of rollers 26 straddle a traverse rod 28 also fixed in the frame. The carrier assembly 20 includes a one revolution drive motor 30 i.e., a motor which each time it is energized performs a single revolution. The motor shaft 32 carries a rocker cam 34 (FIG. 3) and also drives a four-to-one reduction gear in the form of a spur gear 36 and a circular internal gear 38. A rocker assemblage 40 (FIG. 3) pivotably mounted on shaft 42 is supported by bearings (not shown) of the assembly 20. The rocker assemblage 40 carries a print element 44 of well known construction. The print element 44 is rotatable and tiltable by means (not shown) to select desired characters for printing. When the motor is driven through one revolution cam 34 acting through cam follower 35 mounted on rocker assemblage 40 causes the latter to rotate about shaft 42 impelling the print element 44 against the platen 30. The operation of the print element 44 and the rocker assemblage 40 has been provided merely as background and will not be discussed further since it forms no part of the present invention which is concerned with controlling the imposition of a ribbon 50 between the print element 44 and the platen 31.

A pair of spaced ribbon guides 52 are pivotably supported at points 54 on carrier assembly 20 completely independently of rocker assemblage 40 and are counterbalanced by cross member 56. The ribbon guides are movable within the arc shown by arrows 58 with a spring 60 biasing the guides to assume a bottom most position.

The ribbon guides 52 are raised from this bottom most position by means of eccentric 62 connected thereto for rotation about point 54. The eccentric 62 is pinned by pin 65 to link 64 whose other end is connected to another eccentric 66 rotatably mounted at point 63 on carrier assembly 20. A shaft in eccentric 66 at the connecting point 69 carries a cam follower 68 and the other end of link 64.

Figure 4:
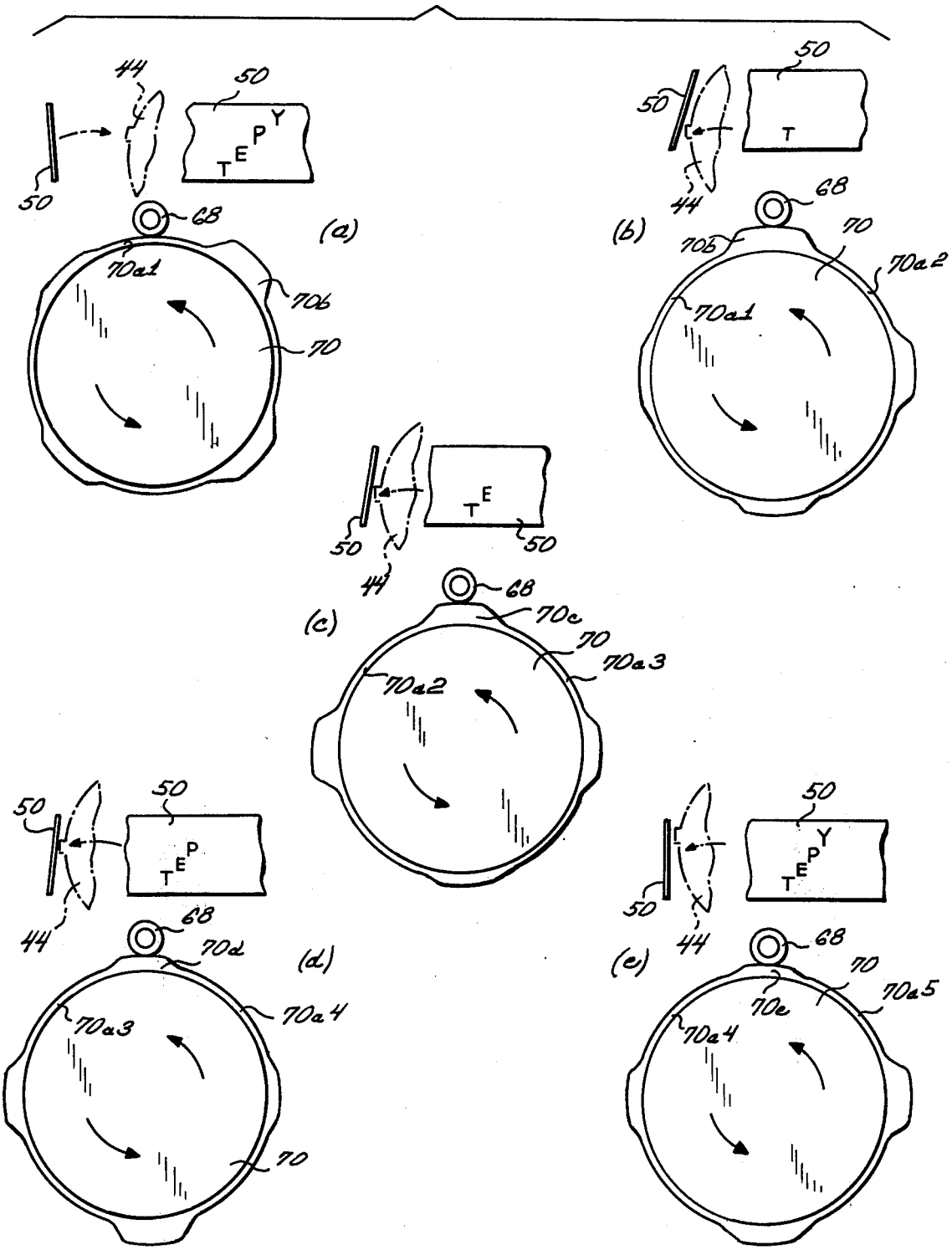
FIG. 4 is a schematic view of cam positions and their effect on the positioning of the ribbons.

Cam follower 68 rides on cam 70. Note that cam 70 is on the outer surface of circular internal gear 38. The geometry of cam 70 is best seen in FIG. 4 which shows the profile of the cam with four equispaced lobes about each 90° point of a circle interposed by four valleys. Each lobe has a different height while all the valleys 70*a* have the same height. The lobes 70*b* to 70*e* have different heights with lobe 70*b* being the highest and lobe 70*e* the least high.

As cam 70 rotates, cam follower 68 causes eccentric 66 to rotate driving link 64 which causes eccentric 62 to rotate. The rotation of eccentric 62 causes the ribbon guides to pivot through the arc. However, there is never at any one time a complete rotation of cam 70. It will be recalled that motor 30 is of the one revolution type and that the spur gear 36 and internal gear 38 form a four to one reduction gear. The cam 70 is phased so that at the beginning and end of each revolution of motor 30 the cam follower 68 rests in a valley 70*a* see view (*a*) of FIG. 4. When the follower 68 is in a valley the ribbon guides 52 hold the ribbon 50 at a level such that an operator has an unobstructed view of the impact area of the platen 31 so that the operator cam see the text printed on the available line of a record medium (paper). When the next character is printed the next revolution of the motor 30 causes the cam to move from valley 70*a*1 via lobe 70*b* to valley 70*a*2. During the time follower 68 is riding on lobe 70*b* ribbons guides 52 are raised to their highest position interposing the lower quarter of ribbon 50 opposite the impact area of platen 31. Note cam 70 is placed with respect to cam 34 so that whenever the cam follower 68 is on a lobe, print element 44 is impacting platen 30. At the end of this revolution of motor 30 the cam follower 68 rests in valley 70*a*2. During the printing of the next character cam follower 68 moves from valley 70*a*2 via lobe 70*c* to valley 70*a*3. The height of lobe 70*c* is such that the second lowest quarter of the ribbon 50 is available. See view (*c*) of FIG. 4. Similarly, the lobes 70*d* and 70*e* make available the third lowest (second highest) quarter and highest quarter, respectively, of the ribbon 50. See views (*d*) and (*e*) of FIG. 4.

It should be realized that there is also a longitudinal drive of the ribbon. The ribbon can be incrementally stepped less than a character width for each character or can be stepped a full character width after the printing of each character. Since the longitudinal feed of the ribbon does not form any part of the present invention it will not further be described.

In a typewriter, there is an operating procedure called the stencil mode. In this mode, the print element is driven against the platen carrying a stencil which is cut with characters upon impact of the print element. Therefore, during the stencil mode it is necessary to disable the ribbon lifting mechanism. Accordingly, there is provided a lever 80 pivotably mounted at pin 82. One arm 84 has a pair of teeth 84*a* and 84*b* riding in slotted disk 86 fixed cam 70. Thus when the other arm 88 of lever 80 is moved from the position shown in FIG. 2 to the dotted position therein, cam 70 is axially moved out of engagement with follower 68. At that time spring 60 pulls the ribbon guides 52 to their lowest position (equivalent to the cam follower being in valley 70*a*). Thereafter, until the position of the cam is restored, the ribbon stays below the impact area.

In order to prevent accidental movement of the stencil lever 80 an interlock is provided. In particular stencil lever 80 has connected thereto an extension 90 having slots 92 and 94. Opposite the slots is a tooth 96 on the arm of ribbon release lever 98 which pivots about pin 100. When the lever 98 is in the position shown in FIG. 2 the ribbon is tight and tooth 96 is in one of the slots 92 or 94. In this position which is the normal position, printing can be performed, but the position of stencil lever 80 cannot be changed. When the ribbon lever 98 is in the dotted position shown in FIG. 2 the ribbon can be removed if desired and also the position of stencil lever 80 can be changed to engage or disengage cam 70 as desired.

Figure 5:
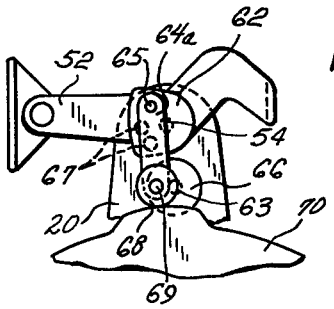
FIG. 5 is a detail of an adjusting means.

Because of the use of a multilobe cam to lift the ribbon guides there is only one variable left to initially adjust the rest position of the guides. As shown in FIG. 1, the adjustment can be made by selecting a link 64 of appropriate length. However, a simpler adjustment is possible by modifying the connection of the cam follower 68 to the guide 52 according to the configuration shown in FIG. 5. Therein eccentric 62 is provided with a series of holes 67 for accepting pin 65, the hole being chosen which provides to best rest position for the guides 54.

While only one embodiment of the invention has been shown and described in detail, there will now be obvious to those skilled in the art many modifications and variations satisfying many or all of the objects of the invention as defined by the appended claims.

For example, the cam 70 can have more or less than four lobes; the motor can be replaced by a continuously rotating motor with a one revolution clutch connecting the motor to the reduction gear; the stencil lever interlock is preferrably the ribbon release mechanisms, but other positive mechanisms can be used.

What is claimed is:

1. In a printer wherein a ribbon is driven against a platen by a print element, ribbon lifting apparatus for controllably positioning different transverse regions of the ribbon between the platen and the print element at the time of impact, said apparatus comprising ribbon guide means for supporting a ribbon between the platen and the print element, pivotable support means for supporting said guide means to pivot through an arc such that different transverse regions of ribbon are available for impact against the platen, spring means for biasing said guide means to pivot in a given direction, a one revolution drive means, an *n*-to-one reduction gear driven by said drive means, an *n*-lobe cam driven by said reduction gear, a shaft, a cam roller rotatably supported by said shaft and resting on said cam, means for supporting said shaft to pivot about a point remote from said shaft, a link having one end connected to said shaft, connecting means for fixedly connecting the other end of said link to said guide means, said connecting means being adjustable so that the rest position of said guide means can be controllably located and disengaging means for disengaging said cam from said follower means whereby said guide means is moved by said spring means out of interposition between said print head and said platen.

2. The ribbon lifting apparatus of claim 1, wherein the lobes are positioned around a circle, the elevations of the lobes being different, and the depth of the valley between the lobes being the same.

3. In a printer wherein a ribbon is driven against a platen by a print element, ribbon lifting apparatus for controllably positioning different transverse regions of the ribbon between the platen and the print element at the time of impact, said apparatus comprising ribbon guide means for supporting a ribbon between the platen and the print element, pivotable support means for supporting said guide means to pivot through an arc such that different transverse regions of tape are available for impact against the platen, spring means for biasing said guide means to pivot in a given direction, a one revolution drive means, an *n*-to-one reduction gear driven by said drive means, an *n*-lobe cam driven by said reduction gear, a cam follower means resting on said cam and connected to said guide means for controlling the position of said guide means along said arc in accordance with the profile of said cam, and disengaging means for axially displacing said cam from said cam follower means whereby said guide means is moved by said spring means out of interposition between said print element and said platen.

4. The ribbon lifting apparatus of claim 3 wherein said cam follower means also includes a cam roller, a link having a shaft at one end thereof for rotatably carrying said cam roller, and connecting means for connecting the other end of said link to said guide means, said connecting means being adjustable so that said arc can be controllably positioned.

5. The ribbon lifting apparatus of claim 3 further comprising interlock means for controlling the operation of said disengaging means.

6. The ribbon lifting apparatus of claim 5 wherein said interlock means comprises a ribbon cartridge release lever provided with a pair of slots means for pivotably mounting said cartridge release lever, a stencil lever provided with a tooth for alternately entering each of said slots, means for pivotably mounting said stencil lever, said stencil lever being connected to said cam whereby movement of said stencil lever results in engagement and disengagement of said cam and said cam follower means.

7. The ribbon lifting apparatus of claim 3 wherein the lobes are positioned about a circle, the elevations of the lobes being different, and the depth of the valley between the lobes being the same.

* * * * *